US007935642B2

(12) United States Patent
Kool et al.

(10) Patent No.: US 7,935,642 B2
(45) Date of Patent: May 3, 2011

(54) REPLENISHMENT METHOD FOR AN ADVANCED COATING REMOVAL STRIPPING SOLUTION

(75) Inventors: Lawrence B. Kool, Clifton Park, NY (US); Gabriel K. Ofori-Okai, Albany, NY (US)

(73) Assignee: General Electric Company, Schenectady, NY (US)

( * ) Notice: Subject to any disclaimer, the term of this patent is extended or adjusted under 35 U.S.C. 154(b) by 781 days.

(21) Appl. No.: 11/941,461

(22) Filed: Nov. 16, 2007

(65) Prior Publication Data

US 2009/0132175 A1 May 21, 2009

(51) Int. Cl.
*H01L 21/302* (2006.01)

(52) U.S. Cl. .... 438/745; 438/750; 216/104; 156/345.18

(58) Field of Classification Search ..... 438/745, 438/750; 216/104, 106, 107; 156/345.15, 156/18

See application file for complete search history.

(56) References Cited

U.S. PATENT DOCUMENTS

| | | | | |
|---|---|---|---|---|
| 6,599,416 | B2 | 7/2003 | Kool et al. | |
| 6,758,914 | B2 | 7/2004 | Kool et al. | |
| 6,833,328 | B1 | 12/2004 | Kool et al. | |
| 6,863,738 | B2 | 3/2005 | Kool et al. | |
| 6,953,533 | B2 | 10/2005 | Kool et al. | |
| 2002/0197869 | A1 * | 12/2002 | Nakagawa et al. | 438/689 |
| 2004/0074873 | A1 | 4/2004 | Kool et al. | |
| 2004/0169013 | A1 | 9/2004 | Kool et al. | |
| 2006/0189498 | A1 * | 8/2006 | Anselmi et al. | 510/202 |

* cited by examiner

*Primary Examiner* — Lan Vinh

(74) *Attorney, Agent, or Firm* — Edward J. Smith; Ernest G. Cusick; Frank A. Landgraff

(57) ABSTRACT

A method for calculating the amount of solution components to add to an advanced coating removal (ACR) stripping solution in a coating removal stripping bath to replenish and recover stripping potential. The stripping effectiveness may be restored by the addition of only the primary acid of the composition of acids of the stripping bath and fresh water, in an amount necessary to restore the stripping solution to its original density.

20 Claims, 5 Drawing Sheets

REPLENISHMENT METHOD FOR AN ADVANCED COATING REMOVAL STRIPPING SOLUTION

BACKGROUND OF THE INVENTION

The present invention relates generally to method for chemically removing materials from substrates and more particularly to a method for calculating a correct amount of solution components required to replenish and recover the stripping potential for a coating removal stripping bath.

As operating temperatures of gas turbine engines increase to achieve improved fuel efficiency, advanced oxidation-resistant coatings are required for better environmental protection, as well as improved thermal barrier coating life. Current coatings used on components in gas turbine hot sections, such as blades, nozzles, combustors, and transition pieces, generally belong to one of two classes: diffusion coatings or overlay coatings.

State-of-the-art diffusion coatings are generally formed of aluminide-type alloys, such as nickel-aluminide, platinum-aluminide, or nickel-platinum-aluminide. Overlay coatings typically have the composition MCrAl(X), where M is an element from the group consisting of Ni, Co, Fe, and combinations thereof, and X is an element from the group consisting of Y, Ta, Si, Hf, Ti, Zr, B, C, and combinations thereof. Diffusion coatings are formed by depositing constituent components of the coating, and reacting those components with elements from the underlying substrate, to form the coating by high temperature diffusion. In contrast, overlay coatings are generally deposited intact, without reaction with the underlying substrate.

It has become commonplace to repair turbine engine components, particularly airfoils, and return those components to service. During repair, any coatings are removed to allow inspection and repair of the underlying substrate.

In U.S. Pat. No. 6,833,328, Kool et al. disclosed a method for selectively removing one or more coatings from the surface of a substrate. This method is capable of removing substantially all of the coating material, while not attacking the substrate itself. At the same time, the process does not generate unacceptable amounts of hazardous fumes. Moreover, the process is capable of removing a substantial amount of coating material that might be located in indentations, hollow regions, or holes in the substrate, e.g., passage holes in a superalloy substrate. The coating is treated with an aqueous composition which, includes an acid of the formula $H_xAF_6$, or precursors to such an acid. In that formula, A is Si, GE, Ti, Al, and Ga; and x is 1-6. The acid is often hexafluosilic ($H_2SiF_6$). The composition may sometimes include at least one additional acid, such a phosphoric acid. The coating being removed is often an aluminide coating or an M CrAl(X)-type material. The substrate is usually a polymer or a metal, such as a superalloy.

In U.S. Pat. No. 6,863,738, Kool et al. disclosed a method for selectively removing oxide material from the surface of a substrate or coating disposed on the substrate is disclosed. The method includes the step of contacting the oxide material with an aqueous treatment composition having the formula $H_xAF_6$, wherein A can be Si, Ge, Ti, Zr, Al, and Ga; and x is 1-6. The composition can sometimes include an additional acid, such as phosphoric acid, nitric acid, sulfuric acid, hydrochloric acid, hydrofluoric acid, and mixtures thereof. A method for replacing a worn or damaged protective coating applied over a substrate, utilizing the treatment composition, is also described.

In U.S. Publication 2004/0169013, Kool et al. disclosed a chemical composition for selectively removing an aluminum-containing material from a substrate comprises an acid having a formula of $H_xAF_6$, a precursor thereof, and a mixture of said acid and said precursor; wherein A is selected from the group consisting of Si, Ge, Ti, Zr, Al, and Ga; and x is in a range from 1 to 6, inclusive. The chemical composition can comprise at least another acid selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, mixtures thereof, and precursors thereof. The chemical composition can be used to remove aluminum seal strips selectively from the dovetail of a turbine-engine blade. One aspect of the invention further comprises a third acid or precursor, an embodiment of which includes hydrochloric acid as the third acid.

Various techniques, described in Kool '013, can be used to treat the substrate with the aqueous composition. For example, the substrate can be continuously sprayed with the composition, using various types of spray guns. A single spray gun could be employed. Alternatively, a line of guns could be used, and the substrate could pass alongside or through the line of guns (or multiple lines of guns). In another alternative embodiment, the coating removal composition could be poured over the substrate (and continuously recirculated.

In preferred embodiments for Kool '013, the substrate is immersed in a bath of an aqueous composition comprising at least the primary acid, and optionally the second and third acids. In addition, the aqueous composition in the bath may be circulated past the surface of the substrate by, for example, a pumping action. Alternatively in Kool '013, a movement may be imparted to the substrate to effect an agitation for mitigating any depletion of the acids near the surface of the substrate because of the reaction between the acids and the aluminum-containing materials. Immersion and a relative motion between the substrate and the chemical composition in this manner (in any type of vessel) often permits the greatest degree of contact between the aqueous composition and the aluminum-containing coating or material, which is being removed. Immersion time and bath temperature will depend on many of the factors described above, such as the type of coating being removed, and the acid (or acids) being used in the bath.

Usually (Kool '013), the bath is maintained at a temperature up to about 100.degree. C., preferably in the range of about 20.degree. C. to about 100.degree. C., while the substrate is immersed therein. In preferred embodiments, the temperature is maintained in the range of about 45.degree. C. to about 90.degree. C. The immersion time may vary considerably, but is usually in the range of about 10 minutes to about 72 hours, and preferably, from about 1 hour to about 20 hours. Longer immersion times may compensate for lower bath temperatures. After removal from the bath (or after contact of the coating by any technique mentioned above), the substrate is typically rinsed in water, which also may contain other conventional additives, such as a wetting agent.

However, it is known that the stripping effectiveness of such stripping agents will diminish with time. Reduced effectiveness may result from dissipation of the stripping agents due to chemical reaction or evaporation of volatile elements. Accordingly, there is a need for a simple and effective methodology to determine how much of the ACR stripping solution components and fresh water must be added to rejuvenate the bath.

BRIEF DESCRIPTION OF THE INVENTION

The present invention relates to a method for determining the correct amount of solution components to be added to refresh the stripping capability of an advanced coating removal (ACR) stripping solution.

According to a first aspect of the present invention, a method is provided for calculating the correct amount of solution components to add to an advanced coating removal stripping bath to replenish and recover stripping potential wherein a chemical composition for the bath includes a first compound selected from the group consisting of primary acids having a formula of $H_xAF_6$, a precursor thereof, and a mixture of said acid and said precursor; wherein A is selected from the group consisting of Si, Ge, Ti, Zr, Al, and Ga; and x is in a range from 1 to 6, inclusive; a second compound selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures thereof; and a third component of hydrochloric acid. The method includes measuring the starting density and starting volume of the ACR stripping solution in the coating removal stripping bath; measuring the final density and final volume of the ACR stripping solution after operation of the coating removal stripping bath; and calculating the amount of the primary acid and the water to be added to the ACR stripping solution to rejuvenate the stripping effectiveness.

According to a second aspect of the present invention, a method is provided for operating a coating removal stripping bath to maintain the stripping effectiveness of an advanced coating removal (ACR) stripping solution where a chemical composition for the bath includes a first compound selected from the group consisting of primary acids having a formula of $H_xAF_6$, a precursor thereof, and a mixture of said acid and said precursor; wherein A is selected from the group consisting of Si, Ge, Ti, Zr, Al, and Ga; and x is in a range from 1 to 6, inclusive; a second compound selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures thereof; and a third component of hydrochloric acid.

The method includes providing an ACR stripping solution in a coating removal stripping bath. Initially, a starting density and a starting volume of the ACR stripping solution in the coating removal stripping bath are measured. After operation of the coating removal stripping bath, a final density and a final volume of the ACR stripping solution are measured. A calculation is made of an amount of the primary acid and an amount of fresh water to be added to the ACR stripping solution to rejuvenate the stripping effectiveness. The method includes initially providing an ACR stripping solution in the coating removal stripping bath; measuring a starting density and a starting volume of the ACR stripping solution in the ACR stripping bath; measuring the final density and final volume of the ACR stripping solution after operation of the stripping bath; and calculating the amount of the primary acid and the amount of water to be added to the ACR stripping solution to rejuvenate the stripping effectiveness.

According to a further aspect of the present invention, a method is provided for calculating the correct amount of solution components to add to an advanced coating removal (ACR) stripping bath to replenish and recover stripping potential for a chemical composition for the bath, which includes a first compound of a primary acid, hexafluosilic acid $H_sSiF_6$; a second compound of phosphoric acid $H_3PO_4$; and a third component of hydrochloric acid HCl. The method includes measuring the starting density and starting volume of the ACR stripping solution in the ACR stripping bath. After operation of the stripping bath the final density and final volume of the ACR stripping solution are measured. An amount of hexafluosilic acid and an amount of fresh water to be added to the ACR stripping solution to rejuvenate the stripping effectiveness is then calculated.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing a calculation for the correct amount of solution components to be added to replenish and recover the stripping potential for an ACR stripping solution.

As the ACR solution is used to strip components, its effectiveness gradually diminishes. Stripping cycle times increase unacceptably. Previously, the ACR solution in a coating removal stripping bath (also referred to as "bath") would be discarded when it was thought to be spent.

Alternatively, titrations, elemental analysis and other analytic techniques have been previously used to characterize the concentrations of the individual acid mixes of the ACR solution for the purpose of determining how much of each of the individual solution components to add in order to refresh the bath. Such an approach is time-consuming and technician-intensive.

Accurate replenishment of the stripping solution may significantly increase the bath life, thereby decreasing chemical costs and downtime and providing increased throughput. The overall effect is to increase productivity and decrease chemical discharge.

Analysis was performed on exemplary ACR stripping solutions from the set of acid combinations described in U.S. Publication 2004/0169013 by Kool et al. Based on analysis, it has been determined that that the primary acid is depleted during ACR process and that there is a considerable evaporation of both the primary acid and water from the bath that results in an increase in density. These data are input into an inventive algorithm whose technical effect is to prescribe the relative amounts of fresh primary acid and water to be added to replenish the bath and recover stripping effectiveness. The algorithm determines the amount of primary acid and fresh water necessary to restore the density of the stripping solution to that provided in a fresh charged ACR solution.

Figure 1:
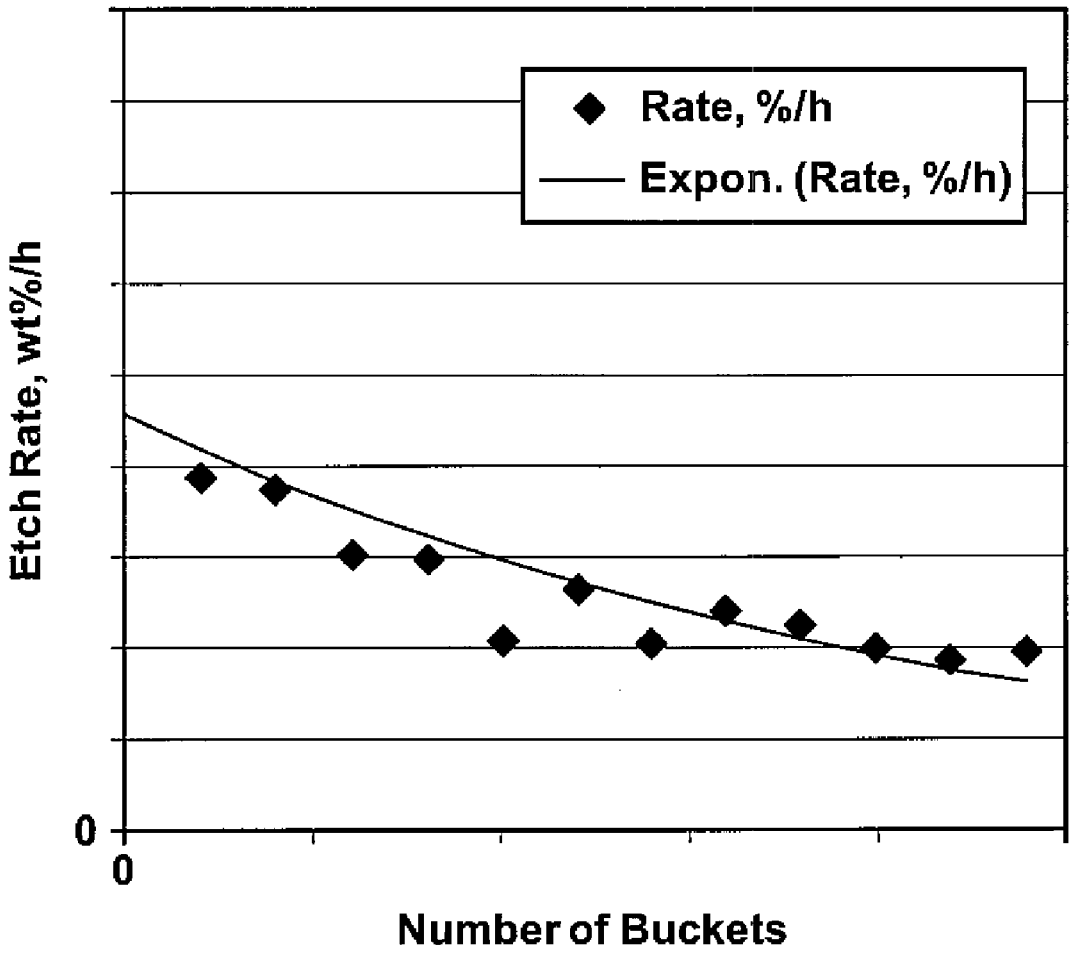
FIG. 1 illustrates a plot of etch rate vs. number of buckets stripped.
Figure 2:
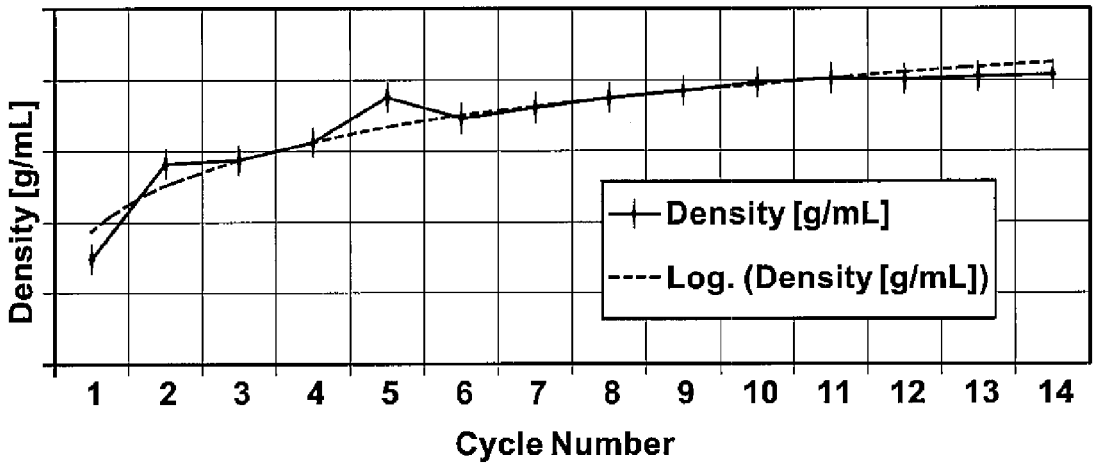
FIG. 2 illustrates a plot of ACR solution density vs. cycle number.
Figure 3:
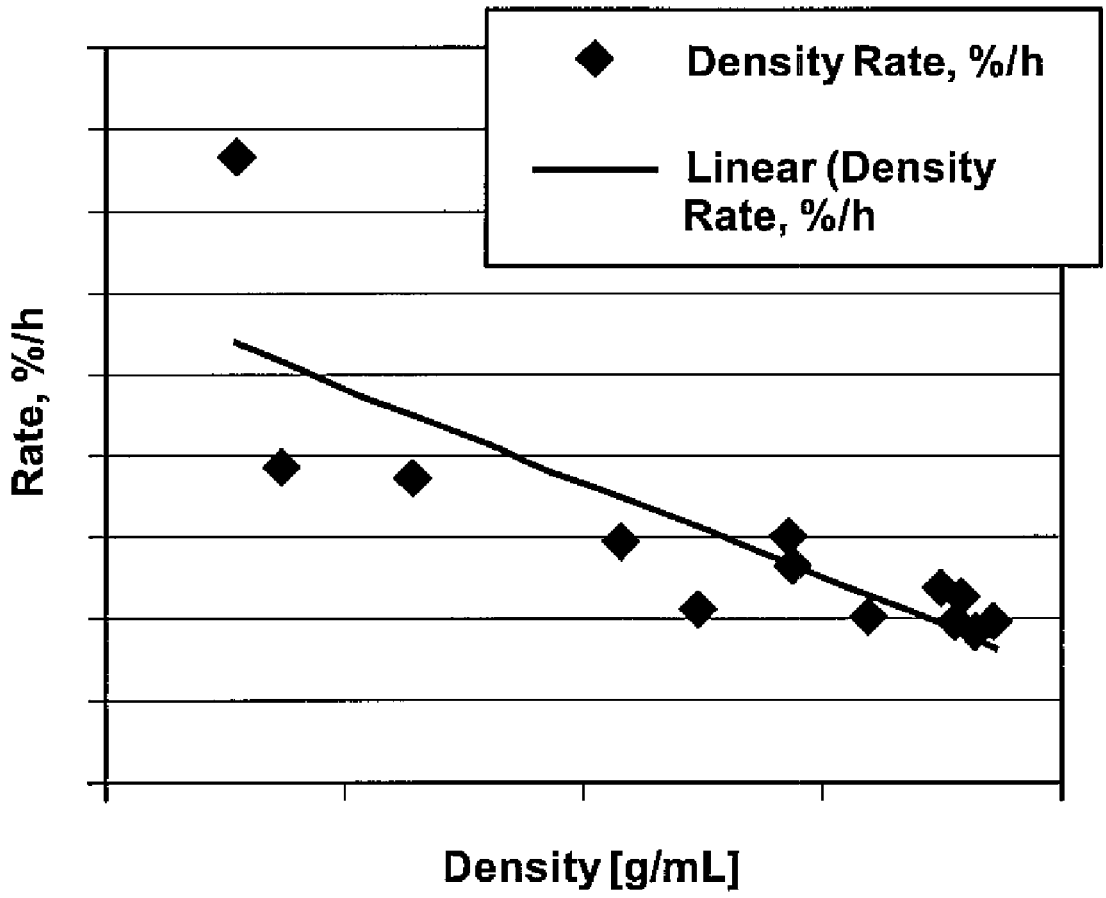
FIG. 3 illustrates a plot of the etch rate vs. density for the ACR solution.
Figure 4:
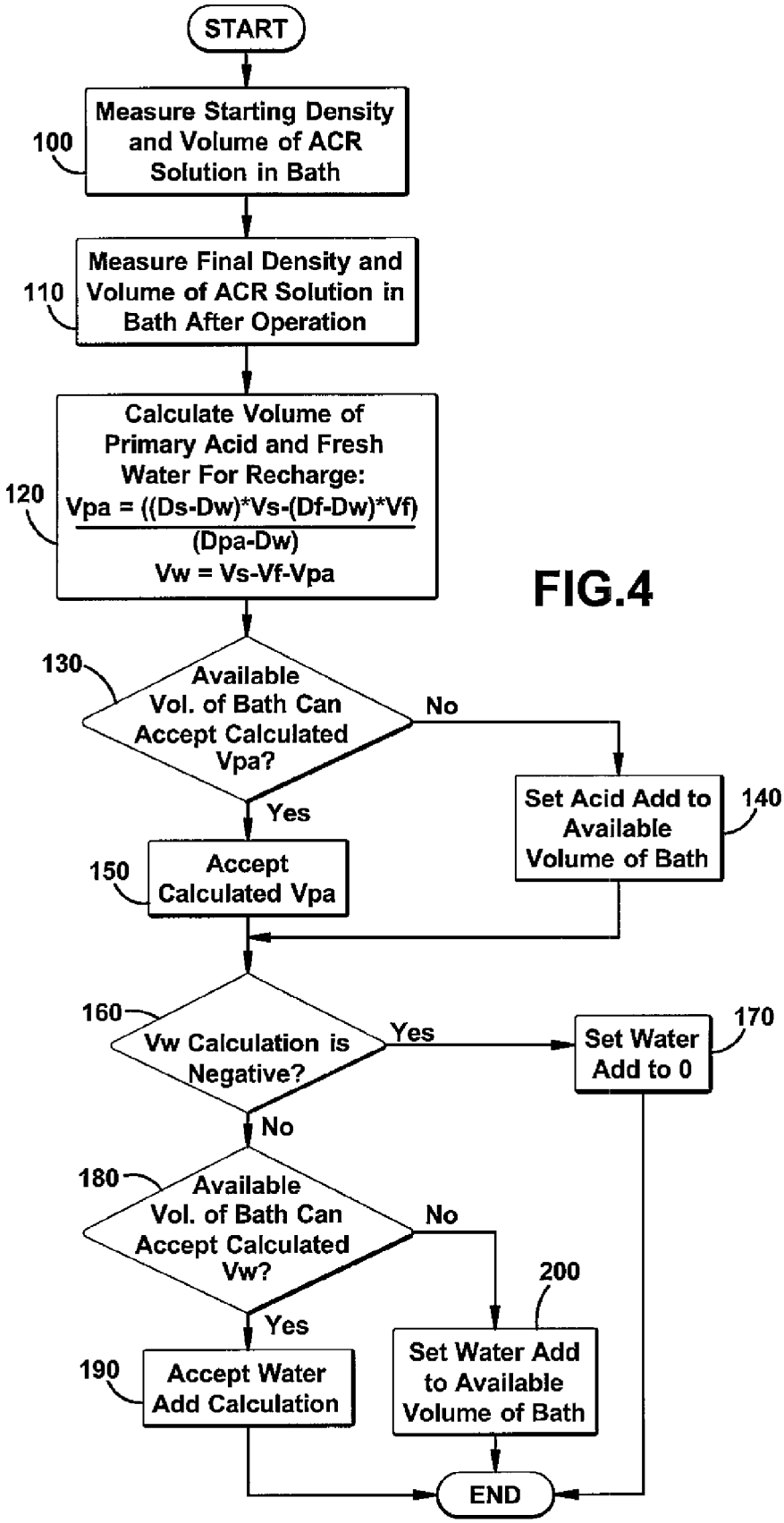
FIG. 4 illustrates a flow chart for a method of calculating the amount of primary acid and fresh water to be added to recharge a coating removal stripping bath.

Analysis with an exemplary ACR stripping solution reaffirmed the well-known operational observation of the stripping process that the etch rate decreases over time as shown in FIG. 1, which illustrates a plot of etch rate vs. number of buckets stripped. Further, it was observed that stripping bath density increases over time. FIG. 2 plots the ACR solution density vs. cycle number, showing the density increases logarithmically with cycle number. During stripping, coatings are removed by dissolution. The products of these dissolution reactions are metal salts of the respective acids, which are higher in density than the acids. An additional factor that causes an increase in density is the evaporation of volatile species in the acid, both water and volatile acids. FIG. 3 plots the etch rate vs. density for the ACR solution. A linear relationship exists between the etch rate and overall solution density where the etch rate decreases with increasing density of the ACR solution.

Titrations, elemental analysis and other analytic techniques have been previously used to characterize the concentrations of the individual acid mixes of the ACR solution. Testing associated with this invention has led to the recognition that restoration of stripping effectiveness may be restored by restoring the original density of the fresh ACR stripping solution with additions of only the primary acid and fresh water without the need for the titrations, elemental analysis and other analytic techniques previously used to characterize the ACR solution and calculate fresh charges.

To restore the density of the ACR stripping solution to its starting value in order to restore its stripping effectiveness, an unknown volume of the primary acid and an unknown volume of fresh water must be added. The weight of the replenished ACR stripping solution will equal the weight of the final volume of the ACR stripping solution plus the weight of the added primary acid and the weight of the added fresh water. As applied in an equation 1:

$$Ds*Vs=De*Ve+Dpa*Vh+Dw*Vw \qquad \text{Equation 1,}$$

where Ds is the starting density of the solution; Vs is the starting volume of the solution; De is the ending density of the solution; Ve is the ending volume of the solution; Dpa is the density of the primary acid; Dw is the density of fresh water; Vpa is the volume of the added primary acid; and Vw is the volume of added fresh water.

Equation 2 provides a relation between the starting volume of the solution and the measured volume following operating and the evaporated primary acid volume and evaporated water volume:

$$Vs=Ve+Vpae+Vwe \qquad \text{Equation 2.}$$

Combining Equation 1 and Equation 2 leads to Equation 3, which provides a solution for the volume of evaporated primary acid:

$$Vpae=((Ds-Dw)*Vs-(De-Dw)*Ve))/(Dpa-Dw) \qquad \text{Equation 3.}$$

The calculated volume of primary acid to be added (Vpa) for replenishment of the bath equals the amount of primary acid evaporated (Vpae):

$$Vpa=Vpae=((Ds-Dw)*Vs-(De-Dw)*Ve))/(Dpa-Dw) \qquad \text{Equation 4.}$$

Equation 5 provides a calculation for the volume of fresh water to be added in the recharge, where:

$$Vwe=Vs-Ve-Vpae \qquad \text{Equation 5.}$$

The calculated volume of fresh water (Vw) to be added for replenishment of the bath equal the amount of evaporated water (Vwe):

$$Vw=Vwe=Vs-Ve-Vpae \qquad \text{Equation 6.}$$

The solution may be applied to an exemplary ACR stripping solution comprising approximately 71.25% $H_2SiF_6$, 23.75% $H_3PO_4$ and 5% HCl by volume. These concentrations are % v/v of 23% HFS, 80% phosphoric and 37% HCl. It is also possible to use a modified recipe that uses 20% HCl.

Similarly when hexafluosilic acid ($H_2SiF_6$) is the primary acid, equation 7 calculates the amount of the primary acid, $H_2SiF_6$, to be added to a bath of stripping solution to restore the density to the initial value and thereby restore the stripping effectiveness:

$$VHFs=((Ds-Dw)*Vs-(De-Dw)*Ve))/(D_{HFS}-Dw) \qquad \text{Equation 7,}$$

where Ds is the starting density of the solution; Vs is the starting volume of the solution; De is the ending density of the solution; Ve is the ending volume of the solution; $D_{HFS}$ is the density of the primary acid; Dw is the density of fresh water; $V_{HFS}$ is the volume of the primary acid addition to replenish the bath; and Vw is the volume of fresh water to replenish the bath.

Equation 8 calculates the amount of water to be added to a bath of stripping solution to restore the density to the initial value and thereby restore the stripping effectiveness:

$$Vw=Vs-Ve-V_{HFS} \qquad \text{Equation 8.}$$

Figure 5:
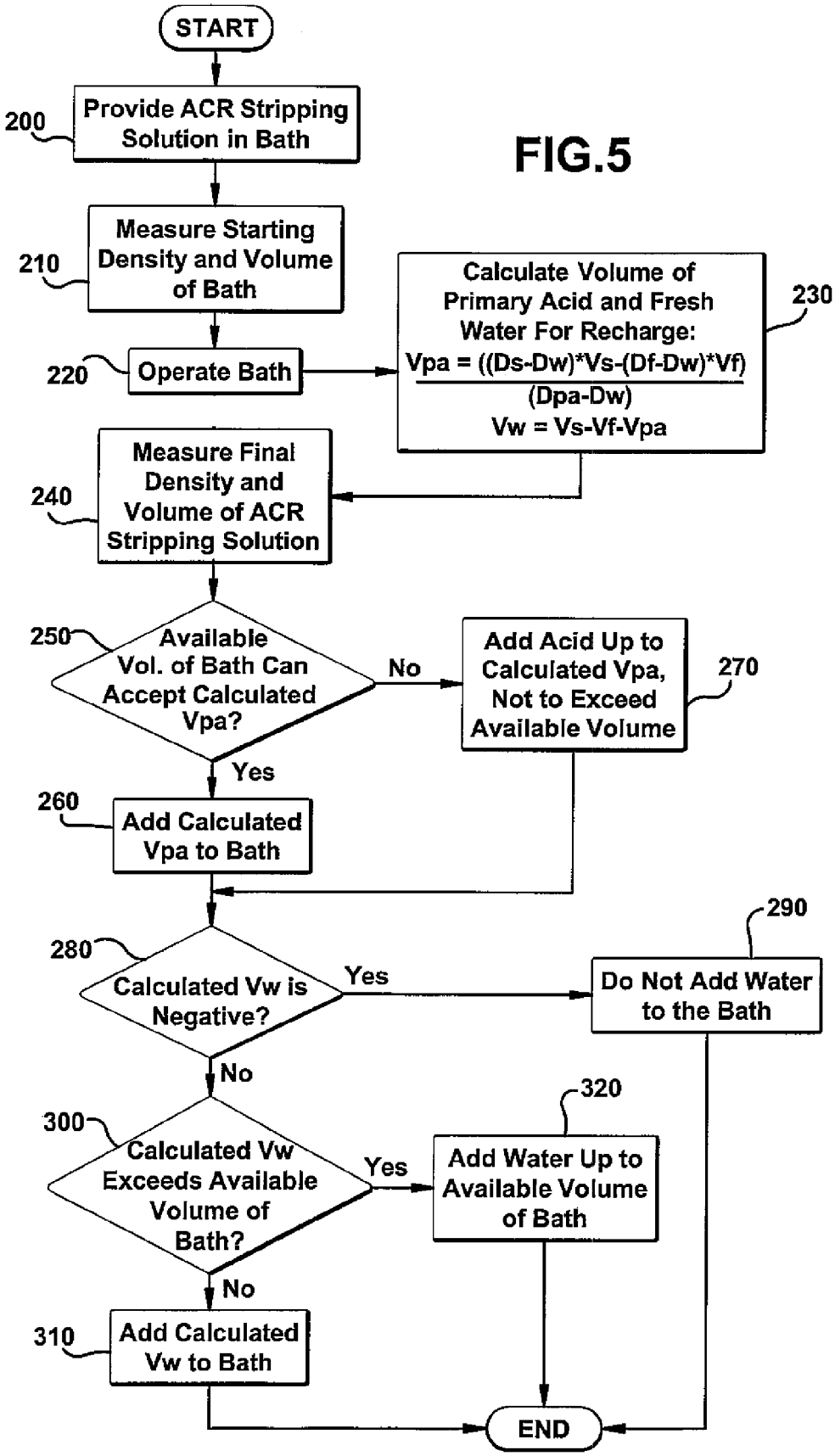
FIG. 5 illustrates a flow chart for a method of operating a coating removal stripping bath to maintain the stripping effectiveness for an ACR stripping solution.

FIG. 5 illustrates a flow chart for a method of calculating the amount of primary acid and fresh water to be added to recharge an ACR stripping bath. In step 100, the density and volume of the ACR stripping solution in the stripping bath are measured. In step 110, the final density and volume of the ACR stripping solution are again measured after a period of stripping operation. Using the measured values for the starting and the final densities and volumes of the ACR stripping solution, a volume of primary acid and a volume of fresh water to be added to the ACR stripping solution are calculated in step 120 according to Equations 3 and 4, the equations having been previously described.

In some instances, the ACR bath may not have sufficient unfilled volume to add the amounts of primary acid and fresh water, as calculated. In step 130, the available volume is compared against the calculated primary acid addition value. If the ACR bath does not have sufficient volume to accept the calculated amount of primary acid to be added, then, in step 140, the volume of acid for addition should be limited to a value that may be accepted by the bath. If the available volume of the bath is sufficient to accept the calculated volume of primary acid, the calculated value is accepted in step 150.

In step 160 it is determined if the calculated amount of the fresh water to be added to the tank is negative. If the calculated value for the fresh water addition is negative, then the amount of fresh water to be added to the bath should be 0 per step 170. In step 180, it is determined if the calculated amount of fresh water to be added can be accommodated in the volume of the stripping bath after the addition of the primary acid charge. If the calculated amount of water to be added to the bath can be accepted by the bath after the primary acid charge has been added, then the calculated value for the fresh water addition should be accepted per step 190 If the available volume of the bath cannot accept the calculated amount of fresh water to be added, then in step 195, the fresh water add should be limited to the remaining capacity for the bath.

FIG. 6 illustrates a flow chart for a method of operating an advanced coating removal stripping bath to maintain the stripping effectiveness for an ACR stripping solution. Initially in step 200, the ACR stripping bath is provided with either a fresh charge of ACR stripping solution or a previously rejuvenated ACR stripping solution. In step 210, the density and volume of the ACR stripping solution in the stripping bath are measured. In step 220, stripping operations are performed on the bath. In step 230, the final density and volume of the ACR stripping solution are again measured after the stripping operation.

Using the measured values for the starting and the final densities and volumes of the ACR stripping solution, a volume of primary acid and a volume of fresh water to be added to the ACR stripping solution are calculated in step 240 according to equations 3 and 4, the equations having been previously described. In some instances, the ACR bath may not have sufficient unfilled volume to accommodate the amounts of primary acid and fresh water, as calculated.

In step 250 it is determined if the available volume of the bath can accept the calculated value of primary acid, Vpa. If the bath can accept the calculated volume of primary acid, then the primary acid is added to the bath in step 260. If the bath does not have sufficient volume to accept the calculated volume of primary acid, then in step 270 acid is added to the bath up to the calculated value of Vpa, but not to exceed the available volume. In step 280, it is determined if the calculated amount of fresh water to be added is a negative value. If the calculated amount of fresh water Vw to be added is negative, then fresh water is not added per step 290. Otherwise, in step 300, it is determined if the calculated amount for Vw exceeds the available volume of the bath. If space is available in the tank, then the calculated fresh water addition is made per step 310. If space is not available, then the fresh water is added up to the calculated Vw, but not to exceed the available volume of the tank.

The measurements of density and volume for the ACR stripping solution may be performed with measurement techniques known in the art. The measurement may be manual or may be automated. The density and volume measurements may be transmitted remotely to indicating systems and/or to computer systems which may incorporate the calculations for the amount of primary acid and fresh water to be added to restore the stripping effectiveness for the ACR solution.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A method for calculating an amount of solution components to add to an advanced coating removal (ACR) stripping solution for a coating removal stripping bath to replenish and recover stripping potential wherein a chemical composition for the coating removal stripping bath includes a first compound selected from the group consisting of primary acids having a formula of $H_xAF_6$, a precursor thereof, and a mixture of said acid and said precursor; wherein A is selected from the group consisting of Si, Ge, Ti, Zr, Al, and Ga; and x is in a range from 1 to 6, inclusive; a second compound selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures thereof; and a third component of hydrochloric acid; the method comprising:

measuring a starting density and a starting volume of the ACR stripping solution in the coating removal stripping bath;

measuring the final density and final volume of the ACR stripping solution after use of the coating removal stripping bath;

calculating an amount of a primary acid and an amount of fresh water to be added to the ACR stripping solution to rejuvenate the stripping effectiveness of the coating removal stripping bath.

2. The method according to claim 1, wherein the ACR stripping solution in the coating removal stripping bath comprises: a fresh bath with an unused charge of ACR stripping solution.

3. The method according to claim 1, wherein the ACR stripping solution in the coating removal stripping bath comprises: a used bath of the ACR stripping solution, previously refreshed with a charge of the primary acid and the fresh water.

4. The method according to claim 1, the step of calculating an amount of an primary acid and an amount of fresh water to be added to the ACR stripping solution to rejuvenate the stripping effectiveness comprising:

calculating an amount of primary acid and the amount of fresh water to restore the density of the ACR stripping solution to the starting density for the coating removal stripping bath.

5. The method according to claim 1, the step of calculating an amount of the primary acid and an amount of fresh water to be added to the ACR stripping solution to rejuvenate the stripping effectiveness further comprising:

calculating an amount of primary acid to be added according to Vpa=((Ds−Dw)*Vs−(Df−Dw)*Vf))/(Dpa−Dw); and calculating an amount of fresh water to be added according to Vw=Vs−Vf−Vpa, where Vs is a starting volume of the coating removal stripping bath; Vf is a final volume of the coating removal stripping bath after bath operation; Vpa is a volume of primary acid to be added; Vw is a volume of the fresh water to be added; Ds is a starting density of the ACR stripping solution; Df is a final density of the ACR stripping solution after bath operation; Dpa is a density of the primary acid and Dw is a density of the fresh water.

6. The method according to claim 5, the step of calculating an amount of the primary acid and an amount of fresh water to be added to the ACR stripping solution to rejuvenate the stripping effectiveness further comprising:

accepting a volume of the primary acid for addition to the coating removal stripping bath up to the calculated volume, but not to exceed a capacity of the coating removal stripping bath;

neglecting the calculated volume for fresh water if the calculated volume for fresh water is a negative value; and accepting a positive value for the calculated volume for the fresh water to be added, up to the capacity of the coating removal stripping bath after the calculated amount of primary acid is considered.

7. The method according to claim 5, wherein the ACR stripping solution comprises:

an aqueous composition which includes a primary acid of a formula $H_2SiF_6$.

8. The method according to claim 7, wherein the ACR stripping solution further comprises:

an aqueous composition which includes a secondary acid of a formula $H_3PO_4$.

9. The method for calculating the correct amount of solution components to add to an advanced coating removal stripping bath according to claim 7, wherein the density of the primary acid is taken to be approximately 1.22 Kilogram per liter and the density of fresh water is taken to be approximately 1.00 Kilogram per liter.

10. A method for operating a coating removal stripping bath to maintain the stripping effectiveness of an advanced coating removal (ACR) stripping solution wherein a chemical composition for the coating removal stripping bath includes a first compound selected from the group consisting of primary acids having a formula of $H_xAF_6$, a precursor thereof, and a mixture of said acid and said precursor; wherein A is selected from the group consisting of Si, Ge, Ti, Zr, Al, and Ga; and x is in a range from 1 to 6, inclusive; a second compound selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures thereof; and a third compound of hydrochloric acid; the method comprising:

providing an ACR stripping solution in a coating removal stripping bath;

measuring a starting density and a starting volume of the ACR stripping solution in the coating removal stripping bath;

measuring the final density and final volume of the ACR stripping solution after use of the coating removal stripping bath; and calculating an amount of a primary acid and an amount of fresh water to be added to the ACR stripping solution to rejuvenate the stripping effectiveness.

11. The method according to claim 10, wherein the providing of the ACR stripping solution comprises:

providing a fresh bath with an unused charge of ACR stripping solution.

12. The method according to claim 10, wherein the providing of the ACR stripping solution comprises:

charging a used bath of ACR stripping solution, previously refreshed with a charge of the primary acid and the fresh water.

13. The method according to claim 10, the step of calculating an amount of the primary acid and an amount of water to be added to the ACR stripping solution to rejuvenate the stripping effectiveness comprising:

calculating an amount of primary acid and an amount of fresh water to restore the density of the ACR stripping solution to the starting density for the bath.

14. The method according to claim 10, the step of calculating an amount of the primary acid and an amount of fresh water to be added to the ACR stripping solution to rejuvenate the stripping effectiveness comprising:

calculating an amount of the primary acid to be added according to Vpa=((Ds−Dw)*Vs−(Df−Dw)*Vf))/(Dpa−Dw); and calculating an amount of the fresh water to be added according to Vw=Vs−Vf−Vpa, where Vs is a starting volume of the stripping bath; Vf is a final volume of the stripping bath after bath operation; Vpa is a volume of primary acid to be added; Vw is a volume of the fresh water to be added; Ds is a starting density of the ACR stripping solution; Df is a final density of the ACR stripping solution after bath operation; Dpa is a density of the primary acid and Dw is a density of the fresh water.

15. The method according to claim 14, further comprising:

adding the primary acid to the coating removal stripping bath up to the calculated volume, but not to exceed the capacity of the coating removal stripping bath;

adding the fresh water up to the calculated volume for a positive calculated value, but not to exceed the capacity of the coating removal stripping bath; and not adding water if the calculated volume for water is a negative value.

16. The method according to claim 14, wherein the ACR stripping solution comprises: an aqueous composition which includes a primary acid of the formula $H_2SiF_6$ and a secondary acid of the formula $H_3PO_4$, and a third component of hydrochloric acid of the formula HCL.

17. A method for calculating an amount of advanced coating removal (ACR) stripping solution components to replenish and recover stripping potential for a chemical composition in a coating removal stripping bath, including a first compound of a primary acid, hexafluosilic acid, ($H_sSiF_6$), a second compound of phosphoric acid ($H_3PO_4$), and a third component of hydrochloric acid (HCL), the method comprising:

measuring a starting density and a starting volume of the ACR stripping solution in the coating removal stripping bath;

measuring a final density and a final volume of the ACR stripping solution after operation of the coating removal stripping bath;

calculating an amount of the hexafluosilic acid and an amount of fresh water to be added to the ACR stripping solution to rejuvenate the stripping effectiveness.

18. The method according to claim 17, wherein the ACR stripping solution in the ACR stripping bath comprises:

at least one of a fresh bath with an unused charge of ACR stripping solution and a used bath of ACR stripping solution, previously refreshed with a charge of the hexafluosilic acid and the fresh water.

19. The method according to claim 17, the step of calculating an amount of the hexafluosilic acid and an amount of the water to be added to the ACR stripping solution to rejuvenate the stripping effectiveness comprising:

calculating an amount of hexafluosilic acid to be added according to Vpa=((Ds−Dw)*Vs−(Df−Dw)*Vf))/(Dpa−Dw); and calculating an amount of fresh water to be added according to Vw=Vs−Ve−Vpa;

where Vs is a starting volume of the coating removal stripping bath; Vf is a final volume of the coating removal stripping bath after bath operation; Vpa is a volume of the hexafluosilic acid to be added; Vw is a volume of the fresh water to be added; Ds is a starting density of the ACR stripping solution; Df is a final density of the ACR stripping solution after bath operation; Dpa is a density of the hexafluosilic acid and Dw is a density of the fresh water.

20. The method according to claim 19, the step of calculating an amount of the hexafluosilic acid and an water to be added to the ACR stripping solution to rejuvenate the stripping effectiveness further comprising:

accepting a calculated volume for the addition of hexafluosilic acid to the stripping bath up to the calculated volume, but not to exceed the capacity of the stripping bath;

neglecting the calculated volume for water if the calculated volume for fresh water is a negative value; and accepting a positive value for the calculated volume for the addition of the fresh water, but not to exceed the capacity of the coating removal stripping bath.

* * * * *